US009830763B2

(12) United States Patent
Unmussig et al.

(10) Patent No.: US 9,830,763 B2
(45) Date of Patent: Nov. 28, 2017

(54) VENDING MACHINE

(75) Inventors: Michael Unmussig, Ettenheim (DE); Thomas Schwarz, Lahr (DE)

(73) Assignee: SES-IMAGOTAG DEUTSCHLAND GMBH, Ettenheim (DE)

( * ) Notice: Subject to any disclaimer, the term of this patent is extended or adjusted under 35 U.S.C. 154(b) by 449 days.

(21) Appl. No.: 14/236,660

(22) PCT Filed: Aug. 3, 2012

(86) PCT No.: PCT/EP2012/003325

§ 371 (c)(1),
(2), (4) Date: Feb. 3, 2014

(87) PCT Pub. No.: WO2013/017288

PCT Pub. Date: Feb. 7, 2013

(65) Prior Publication Data

US 2014/0172159 A1 Jun. 19, 2014

(30) Foreign Application Priority Data

Aug. 4, 2011 (DE) ..... 10 2011 109 373

(51) Int. Cl.

| | |
|---|---|
| ***G07F 11/00*** | (2006.01) |
| ***G07F 7/06*** | (2006.01) |
| ***G07F 11/64*** | (2006.01) |

(52) U.S. Cl.

CPC ..... *G07F 11/002* (2013.01); *G07F 7/06* (2013.01); *G07F 7/0609* (2013.01); *G07F 11/64* (2013.01)

(58) Field of Classification Search

USPC ..... 235/381, 487; 700/232

See application file for complete search history.

(56) References Cited

U.S. PATENT DOCUMENTS 5,007,518 A * 4/1991 Crooks ..... G07F 7/069 194/212
5,020,958 A * 6/1991 Tuttobene ..... G07F 7/069 221/88

(Continued)

FOREIGN PATENT DOCUMENTS

| | | |
|---|---|---|
| EP | 0239110 | 9/1987 |
| EP | 2120220 | 12/2008 |

(Continued)

*Primary Examiner* — Gene Crawford
*Assistant Examiner* — Stephen Akridge
(74) *Attorney, Agent, or Firm* — Volpe and Koenig, P.C.

(57) ABSTRACT

A vending machine having a goods store, a goods dispensing apparatus and a user interface contains a goods input region for inserting goods to be returned and an identification apparatus for the goods which interacts with a data processing device and a data memory. The present invention also relates to a vending machine (40) which is associated with a goods store (2), which goods store (2) is stocked in a manner organized by a plurality of goods carriers (41), wherein a goods input region (4) for inserting old goods intended for replacement, return, or repurchase and an identification apparatus oriented to the input region (4) are provided, and wherein signal transducers (42, 43) are provided which are associated with a goods carrier (41) or with a group of goods carriers (41), wherein said signal transducers (42, 43) have a signal link to the identification apparatus such that following identification of old goods inserted into the goods input region (4) the signal transducer (42, 43) or the signal transducers (42, 43) for a goods carrier (41) or for a group of goods carriers (41) which is/are intended to stock new goods associated with the old goods is/are activated.

12 Claims, 6 Drawing Sheets

(56) References Cited

U.S. PATENT DOCUMENTS 5,880,443 A * 3/1999 McDonald ..... B65G 1/045 198/347.2
6,464,142 B1 * 10/2002 Denenberg ..... G07F 17/0092 235/440
2001/0032035 A1 * 10/2001 Holmes ..... A47B 88/90 700/231
2002/0120332 A1 * 8/2002 Law ..... A61N 1/0526 623/11.11
2003/0170529 A1 * 9/2003 Sagawa ..... G06Q 10/06 429/49
2003/0179085 A1 * 9/2003 Ghabra ..... B60C 23/0416 340/445
2004/0203409 A1 * 10/2004 Swan ..... G06Q 10/087 455/66.1
2005/0216120 A1 * 9/2005 Rosenberg ..... G07F 11/54 700/244
2005/0289032 A1 * 12/2005 Hoblit ..... G06Q 40/00 705/35
2007/0034581 A1 * 2/2007 Weck ..... A47F 5/0823 211/59.1
2007/0050271 A1 * 3/2007 Ufford ..... G06Q 10/087 705/28
2008/0097770 A1 * 4/2008 Low ..... G06Q 20/20 705/304
2009/0308821 A1 * 12/2009 Brand ..... A47F 11/00 211/45
2010/0114367 A1 * 5/2010 Barrett ..... G06F 19/3456 700/236
2011/0060454 A1 * 3/2011 Lowe ..... G06Q 10/06 700/232

FOREIGN PATENT DOCUMENTS

GB 2462319 2/2010
WO 8605292 9/1986
WO 9201273 1/1992
WO 2010040116 4/2010

* cited by examiner

VENDING MACHINE

BACKGROUND

The invention relates to a vending machine which has an associated goods store, which goods store is stocked in ordered fashion by means of a plurality of goods carriers, comprising a goods input region for inserting old goods intended for exchange, return, or new purchase, comprising a data processing device and a data storage device, and comprising signal transducers, which are each associated with a goods carrier or a group of goods carriers, wherein the signal transducers have a signal link to the data processing device.

Such vending machines are known in numerous embodiments, for example cigarette vending machines, drinks vending machines, snacks vending machines or the like. After the insertion of money, product selection and possibly, in the case of cigarette vending machines, age verification via the user interface, the desired product is made accessible from the goods store to the user via the goods output apparatus.

Many goods, for example ink cartridges for printers, can be recycled after use. For this, there are collection points into which the goods can be inserted after use. However, the user often does not have the inducement to do this, with the result that numerous valuable goods are disposed of in the household waste after use and are therefore no longer available to the materials cycle. Furthermore, in the case of those products which are offered in numerous different embodiments, the user is confronted with the problem that it is difficult for him to judge without any expert advice and/or time-consuming study of the various product embodiments which of these product embodiments he now actually requires and which product embodiment would actually be an incorrect purchase for him.

WO-A-92/01273 as prior art has already disclosed a vending machine of the type mentioned at the outset which is used in the car rental industry for dispensing car keys for the customer. These car keys, which form a goods store, are stocked in ordered fashion on a plurality of goods carriers located in the housing interior of the previously known vending machine. In this case, the goods carriers can be configured as spiral bars which are drivable in rotary fashion by a motor and on which the car keys are held, wherein one of these spiral bars can be intended for car keys of large cars, a further spiral bar can be intended for car keys of medium-sized cars and a third spiral bar can be intended for car keys of small cars. The previously known vending machine also has an identification apparatus which is configured, for example, as a card reader and is intended to read the data identifying the user which are stored on a credit card. If a specific user is identified once his data stored on the credit card have been read, a data processing device with a data storage device can assign these data to the motor vehicle intended for the user and the associated car keys. The data processing device transmits a corresponding signal to the motor of the spiral bar drivable in rotary fashion in question, and this spiral bar rotates until the car keys stored at the front of this spiral bar fall into a goods dispenser in order to be removed there by the user once a flap has been opened and released. The previously known vending machine also has a goods input region into which the customer can insert and return the car keys temporarily entrusted to him once the rental period has ended.

The vending machine previously known from WO-A-92/01273 is neither suitable nor intended for stocking such goods on a large number of goods carriers, for identifying old goods, and for assigning the comparable new goods and for leading a customer to the new goods he requires.

US-A-2008/0097770 already discloses a vending machine which is intended for the printer cartridges required for inkjet printers. With the previously known vending machine, the customer can select between refilling a used printer cartridge, purchasing a full printer cartridge, and returning a used printer cartridge in exchange for credit. In paragraph [0028] of US-A-2008/0097770, express mention was made of the fact that the customer not only has to choose between the abovementioned offers and the type of payment he desires, but the customer also needs to determine the printer cartridge he requires. At the latest at this point this would be too much for some customers, however, if such a customer cannot associate the printer cartridge he requires with one of the goods descriptions on offer.

SUMMARY

Therefore, there is in particular the objective of providing a vending machine of the type mentioned at the outset which makes the selection of the goods actually required by the user easier for the user even without any expert advice and time-consuming study of the various product embodiments. In this case, it may be advantageous if the vending machine also offers the user an inducement to return goods after use thereof.

This object is met according to the invention in the case of the vending machine of the type mentioned at the outset in particular in that the vending machine has an identification apparatus for identifying the old goods inserted into the goods input region, in that the signal transducers are in the form of optical and/or acoustically signaling signal transducers, and in that the data processing device interacts with the identification apparatus and has a signal link to the signal transducers, in such a way that, after identification of old goods inserted into the goods input region, the signal transducer or the signal transducers of a goods carrier or a group of goods carriers is/are activated, which goods carrier(s) is/are designated for stocking goods associated with the old goods.

The vending machine according to the invention is associated with a goods supply, which is stocked in an ordered fashion at a plurality of goods carriers. The vending machine according to the invention has a goods input region, which is provided for inserting old goods which are intended for exchange, return, or new purchase. The vending machine according to the invention has an identification apparatus oriented toward the goods input region, which identification apparatus interacts with a data processing device and a data storage device in such a way that old goods inserted into the goods input region are detected by means of the identification apparatus, for example optically on the basis of certain identification features or with the aid of a 3D file, and are matched with identification features or 3D files which are associated with goods in stock or with the goods carrier used for stocking such goods, in the data storage device. The vending machine according to the invention has signal transducers which are associated with a goods carrier or with a group of goods carriers. These signal transducers have a signal link to the data processing device in such a way that, after identification of old goods inserted into the goods input region, the signal transducer of a goods carrier or a group of goods carriers is activated, which signal transducer(s) is/are intended for stocking goods associated with the old goods. The vending machine according to the invention, using the old goods intended for exchange, return or new purchase, therefore facilitates for the user the selection of the stocked goods corresponding to said old goods even in the case of those products which are offered for sale in a large number of embodiments, which are sometimes also difficult to distinguish. Since the vending machine according to the invention has signal transducers which are in the form of optical and/or acoustically signaling signal transducers, simple operability and user guidance at the vending machine according to the invention is facilitated.

In order to be able to stock a large number of different goods, it is expedient if the vending machine has goods carriers which have a protruding holding web or holding clip, on which holding web or holding clip the goods or the packaging thereof can be suspended. The stocked goods can be fastened on such holding webs or holding clips acting as goods carriers by means of their packaging, which has a hanging tab with a through-opening, for example, in such a way that they are easily accessible and removable for the user.

In order to be able to also communicate some goods-specific data, such as, for example, price, product name, manufacturer and the assignment to a superordinate device, to the user prior to removal of suitably signaled goods, it is advantageous if the vending machine has goods carriers which have a display for displaying goods-specific data of the goods stocked in each case by means of the goods carrier.

The precise signaling of the goods identified as suitable or as appropriate is favored if the vending machine has goods carriers which have at least one optical signal transducer.

The vending machine according to the invention can stock a virtually unlimited large number of different goods and offer them for selection if the vending machine has at least one partition wall, on which partition wall goods carriers are preferably fastened detachably.

In this case, a preferred embodiment which can also extend over large wall areas without impairing the expediency of the user envisages that the partition wall of the vending machine is divided into partition wall sections, which partition wall sections have a group of goods carriers, and that each partition wall section has an associated optical and/or acoustic signal transducer.

In order that the vending machine according to the invention can be stocked with the goods respectively to be supplied in a simple manner without the wiring of the vending machine according to the invention needing to be changed every time the vending machine is stocked differently, a preferred development in accordance with the invention envisages that the vending machine has goods carriers with a display and/or a signal transducer, which display and/or signal transducer can be actuated by the data processing device via a wireless link.

In order that the goods carriers can exchange information mutually with the data processing device of the vending machine according to the invention, it is advantageous if the vending machine has goods carriers which are connected to a corresponding transmitter/receiver unit of the data processing device via a transmitter/receiver unit.

In this case, it can be advantageous, for example, if the transmitter/receiver unit of the goods carriers is operated by a (rechargeable) battery, and if the transmitter/receiver unit of a goods carrier, in the event of a state of charge being undershot, transmits a recharge signal to the data processing device, which recharge signal can be read at said data processing device.

In order to provide the user with an inducement to return goods after use thereof, a preferred development in accordance with the invention with its own significance worthy of protection envisages that the vending machine has at least one collecting container for accommodating the returned goods after identification thereof, and that the data processing device is connected to a user interface for a user input depending on the identification result of the identification device.

A person can insert goods to be returned, in particular an empty printer ink cartridge, into the goods input region. The identification apparatus is used to identify which goods the goods are, for example which type of cartridge in terms of the manufacturer, printer model and color. If the goods are identified as goods which are stored in the data storage device and are in stock in the goods store, an amount to be refunded for these goods can be displayed on a display of the user interface. This can be paid out, for example, in the form of an issue of monies. However, it is also possible for the person to be given the offer to purchase corresponding, new goods, wherein the purchase price is reduced by the reimbursement amount for the returned goods. The person can then decide whether he wishes to have the corresponding amount paid out or wishes to purchase new goods at a reduced price. A selection option is also conceivable in accordance with which the person declines the reimbursement amount and takes the goods out of the goods input region again. Likewise, the person can be requested to remove the goods from the goods input region if the inserted goods could not be identified.

If the person has decided to be reimbursed for the goods, the goods are transferred from the goods input region into a collecting container, in order that the goods input region is free again for the next input process. In this case, it is also possible for a plurality of collecting containers to be provided, which are actuated alternately in order to be able to collect different goods in such a way that they are presorted or in order to collect unidentified goods which have not been removed again by the person as waste articles, separately from the goods for which a reimbursement has been made.

Therefore, a universal possible use for the vending machine according to the invention is provided. It is possible for goods to be purchased in a conventional manner without using the return functionality. In addition, goods can be returned in order to allow a reimbursement amount to be paid out or credited, or the return can be used in conjunction with a new purchase, wherein in this case the purchase price for the new goods is reduced by a credit note amount for the returned goods.

An inducement is therefore provided to return reusable goods such as, in particular, empty printer ink cartridges, at vending machines and to recycle them, as a result of which a contribution to waste avoidance is also ensured.

The data processing device can also be designed to allow a plurality of goods to be inserted and identified successively within a user operation, with the result that the return of a plurality of goods with the total reimbursement amount being paid out or credited and/or the purchase of a plurality of goods can be implemented more quickly and more conveniently.

The vending machine according to the invention can in particular be designed for accepting the return of and for purchasing printer ink cartridges. The use of a corresponding vending machine for a large number of different goods, for example mobile telephones, small electrical appliances, batteries, etc., is also possible, however, with the result that a cycle system can be formed for these goods. Various returnable goods need to be distinguished merely in terms of at least one visible feature.

Although automatic returns machines are also already known for returnable bottles, these only enable the return of bottles, without any possibility of directly purchasing a new article. In addition, with these automatic returns machines there is only the issue of a deposit voucher which can be redeemed at the cashdesk of a store in which the automatic returns machine is located. Autonomous operation of such an automatic returns machine is therefore not possible and also not envisaged. The vending machine according to the invention, on the other hand, can be operated independently of a store and can therefore also be installed and operated in public places and in the process enables either the purchase, return, or a combination of a return with the purchase of goods.

It is expedient if the goods input region has an insertion opening which can be closed by means of a closing element which can be moved between an open position and a closed position. The insertion opening firstly enables simple insertion of the goods. Secondly, the goods input region can be closed by the closing element, with the result that the goods input region is only accessible when a person has communicated to the vending machine via the user interface that goods are being returned, and otherwise the goods input region remains closed by the closing element and therefore protected. Closing of the goods input region can also be expedient in order to avoid disruptive influences such as undefined incident light during the goods identification.

The identification device can have an optical identification system, for example a camera.

In this case, the identification apparatus can in particular be designed for barcode identification, three-dimensional surface analysis, 3D matching, logo identification, OCR identification and/or color identification.

The individual identification systems can each be provided individually or preferably in combination with one another in order to be able to identify reliably and clearly the respective goods. A large number of products have a barcode on the outside which enables unique identification. If such a barcode is not provided or is illegible, the identification can be performed by means of logo identification, for example. With a camera, the surface of the goods is detected and investigated for the presence of logos or such identification features. If correspondence with a logo or identification label stored in the data storage device is determined by the data processing device, the goods can be uniquely identified. Likewise, text can be analyzed by means of OCR identification and the goods thus identified. Certain goods can also have colored markings which can be used for the unique identification when such color markings are identified.

The goods identification can also be performed via a surface analysis by virtue of the surface of the goods being scanned in three-dimensional fashion and a comparison of this 3D model being compared with corresponding data in the data storage device. In this case, precise scanning of the contours can take place or determination of the clear dimensions of the goods in all three spatial coordinates is performed, as a result of which practically a virtual rectangular cuboid which is as small as possible is laid around the goods. This 3D matching can also be used as a plausibility check in order to double check, for example, whether an identified barcode corresponds to the inserted goods or whether an attempt at fraud is being made by a fake barcode being applied to an object of no value. In this case, a certain tolerance range can be permitted. If the deviation tolerances between the identified goods and goods information in the data storage device are too great, the goods in question cannot be classified as having been identified.

It is advantageous if the goods input region has a rotatably mounted support element with at least two support plates for goods which are arranged approximately in the form of a V or L.

The goods can thus be inserted into the goods input region in such a way that they rest with one side on one of the support plates. If the identification apparatus cannot identify the goods in this position, the support element can be rotated until the goods rest on the other support plate and thus the previously hidden side of the goods is visible for the identification apparatus. It is thus possible in a manner which is simple in design terms and therefore inexpensive, to be able to scan the goods from a plurality of sides.

In addition, it is possible to allow the positioned goods to drop optionally into one of two collecting containers arranged next to one another beneath the goods input region by rotation of the support element in one or the other direction, and thus acceptable parts which can be reused and unacceptable parts which could not be identified by the identification device and/or which are not reusable can be collected separately.

In this case, it is expedient if the support element has four support plates arranged approximately in the form of a cross so as to form four input compartments arranged one behind the other in the direction of rotation. This makes it possible for the goods to be tipped in order to be able to be scanned from different sides, by virtue of a small rotary movement, as a result of which the identification speed can be increased. Likewise, only a short actuating movement is required in order to bring the support element back into a position suitable for the insertion of new goods once goods have been deposited in a collecting container.

It is advantageous if the surfaces of the support plates are white. Due to the thus resulting contrasts of the goods with respect to the support plates, an improved result in the optical identification of the goods is possible.

A preferred embodiment envisages that the support element and the closing element are rotatable about a common axis of rotation, and that, for this purpose, a hollow shaft and a shaft mounted therein are provided, which shafts are each connected to the support element or the closing element. This enables a simple and space-saving design and simple positioning of the support element and the closing element.

It is also possible for the support element to have scales in order to identify the goods on the basis of their weight or to implement a plausibility check.

A further concept of the invention envisages that a network interface for connecting the vending machine to a network is provided.

This enables numerous applications. For example, the vending machine can be connected or connectable to a database computer for calling up availability information on respective goods. The vending machine can communicate the respective status of the goods store to the database computer, with the result that targeted supply of missing goods to the vending machine is possible.

Likewise, status and fault messages in relation to the vending machine can be transmitted or queried by the database computer. It is also possible to interlink a plurality of vending machines in order to refer a customer to another vending machine with corresponding goods availability if the goods desired by this customer should be out of stock at the respective vending machine. The individual vending machines can in this case communicate with one another either directly or indirectly via a central database computer. It is also conceivable for there to be a link to an Internet ordering system, in which a customer can reserve a specific article over the Internet and pick it up at a desired vending machine.

The user interface can have a display, a keyboard, a touchscreen, a coin slot, a notes slot, a card reader and/or a money issue compartment. Thus, a wide variety of types of operation are possible. Possible operating steps can be displayed on a display, and corresponding inputs can be effected using a keyboard. The display can also be in the form of a touchscreen, with the result that a separate keyboard as input medium can be dispensed with. For payment operations, a coin slot, a notes slot for bank notes and/or a card reader for cashless payment can generally be provided. Change can be returned via a money issue compartment.

The card reader can also be provided for reading loyalty cards. This enables individual control of the vending machine. On the basis of the data of a user profile which can be stored on the loyalty card or in a central database and in the latter case can be called up by inserting the loyalty card into the card reader and preferably after the input of a PIN, it is possible to again offer goods which are often purchased by the respective customer or goods which were purchased most recently, for example, in order to accelerate the shopping operation. If appropriate, a loyalty bonus system can also be provided in order to award a special rebate once a certain number of purchases have been made.

It may be expedient if the goods store has a plurality of goods store modules which can be cascaded with one another. The vending machine can thus be matched to the respective requirements in terms of goods availability and number of different goods on offer. For example, up to 64 goods store modules can be coupled to one another in order to be able to offer a broad product range. In order to install a vending machine at locations with tight space conditions, on the other hand, fewer or even only a single goods store module can be provided.

In this case, it is possible for each goods store module to have a dedicated goods output region. However, it is also possible for the goods output apparatus to have a device for transporting the desired goods from the respective goods store module to a central goods output region, in particular in the region of the user interface, with the result that a customer can remove the purchased goods there from the vending machine.

The invention also relates to a goods input region for a vending machine.

In respect of the goods input region, the invention is characterized by the fact that the goods input region has a rotatably mounted support element with at least two support plates for goods which are arranged approximately in the form of a V or L.

As already described above, the goods can thus be inserted into the goods input region such that they rest with one side on one of the support plates. If an identification apparatus cannot identify the goods in this position, the support element can be rotated until the goods rest on the other support plate and therefore the previously hidden side of the goods is visible to the identification apparatus. Thus, in a manner which is simple in design terms and therefore inexpensive, it is possible to be able to scan the goods from a plurality of sides.

It is also possible for the positioned goods to be allowed to fall optionally in one of two collecting containers arranged next to one another beneath the goods input region by rotation of the support element in one or the other direction, and thus acceptable parts which can be reused and unacceptable parts which could not be identified by the identification device and/or which are not reusable can be collected separately.

In this case, it is expedient if the support element has four support plates arranged approximately in the form of a cross so as to form four input compartments arranged one behind the other in the direction of rotation. This makes it possible for the goods to be tipped in order to be able to scan said goods from different sides, with a small rotary movement, as a result of which the identification speed can be increased. Likewise only a short actuating movement is required in order to bring the support element back into a position suitable for inserting new goods once goods have been deposited in a collecting container.

It is advantageous if the surfaces of the support plates are white. As a result of the thus resulting contrasts of the goods with respect to the support plates, an improved result in the optical identification of the goods is possible.

BRIEF DESCRIPTION OF THE DRAWINGS

An exemplary embodiment of a vending machine according to the invention and a goods input region will be explained in more detail below with reference to the drawings, in which.

DETAILED DESCRIPTION OF THE PREFERRED EMBODIMENTS

Figure 1:
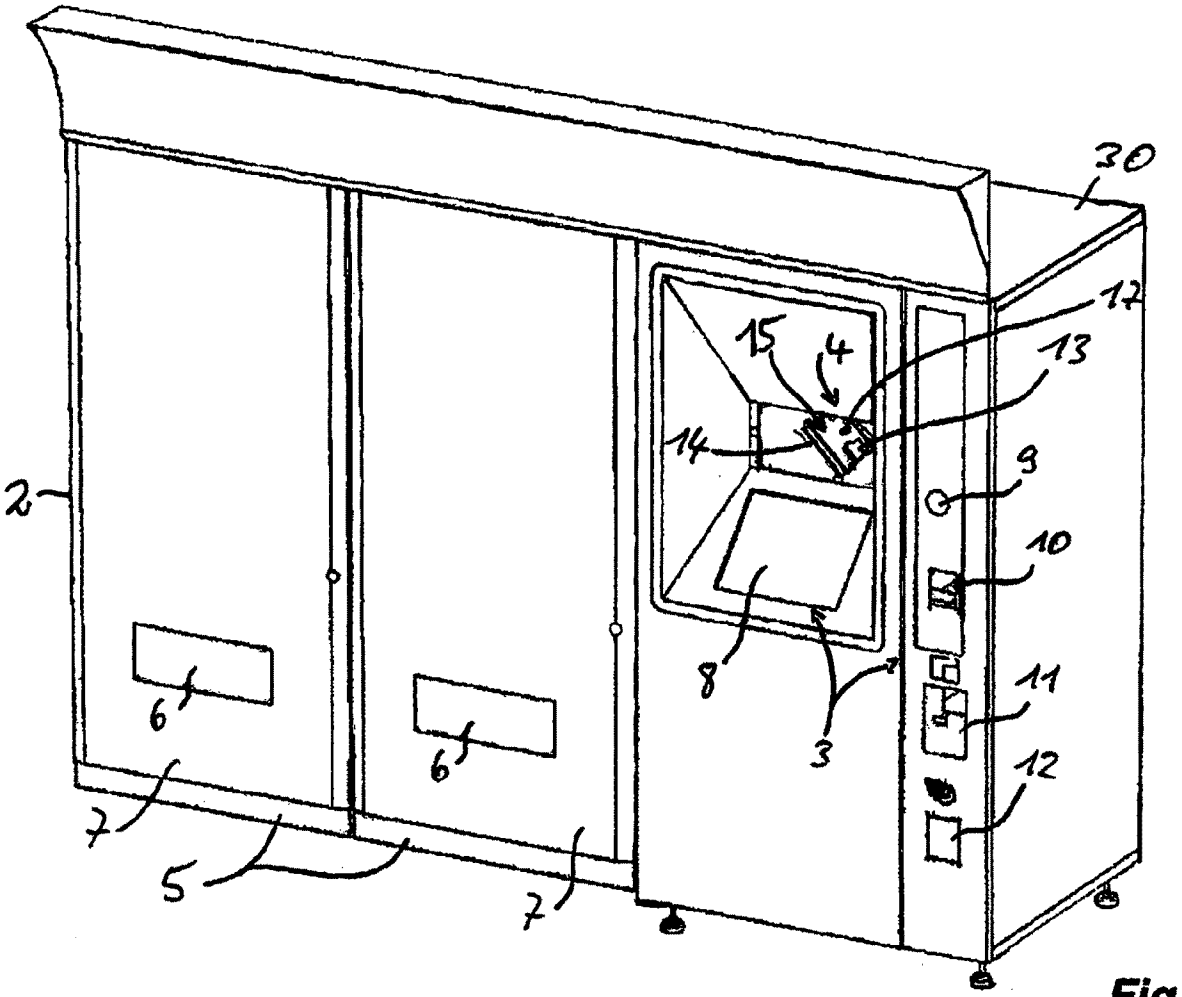
FIG. 1 shows a perspective view of a vending machine.
Figure 5:
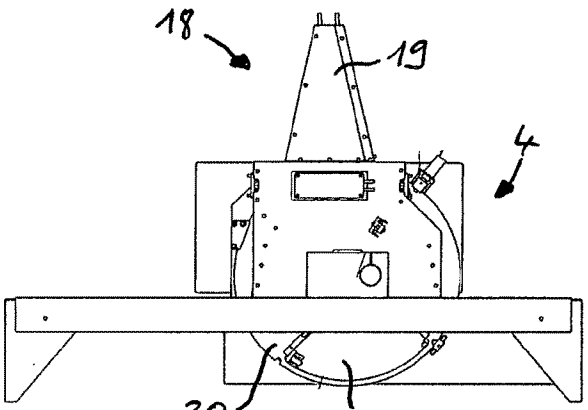
Figure 4:
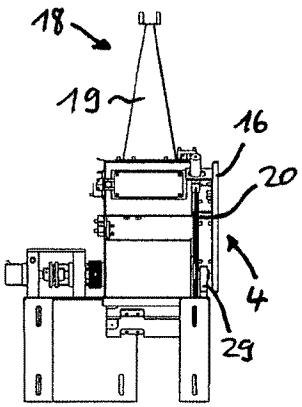
Figure 2:
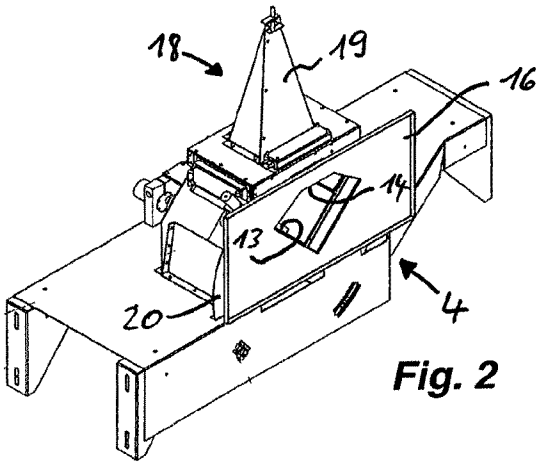
FIG. 2 shows a perspective view of the goods input region of the vending machine shown in FIG. 1, FIG. 3 to FIG. 6 show various side views of the goods input region shown in FIG. 2, FIG. 7 and FIG. 8 show perspective views of the support element of the goods input region with a closing element.

A vending machine denoted as a whole by 1 has, as shown in FIG. 1, a goods store 2, a user interface 3 and a goods input region 4. The goods store 2 is formed by two goods store modules 5, which each have a goods output apparatus 6. The goods store modules 5 each have a door 7, which can be opened in order to stock the goods store modules 5 with goods.

The user interface 3 has in particular a touchscreen 8, via which user inputs and the display of information for a user take place. In addition, other parts of the user interface 3 are illustrated schematically to the side, in particular a coin slot 9, a notes slot 10 for bank notes, a card reader 11 for credit or loyalty cards and a money issue compartment 12.

The vending machine 1 makes it possible to return goods 13, for example a used printer ink cartridge, via the goods input region 4, to purchase new goods or to combine both of these operations with one another.

The respective operation, namely new purchase or return of goods, or the combination of both of these operations, can be selected via the touchscreen 8.

In order to return goods 13, said goods are positioned on a support element 15 through an insertion opening 14 of the goods input region 4. After identification, as explained in more detail below, of the goods 13, a reimbursement price for the goods 13 can be offered to the user via the touchscreen 8, and this can be accepted by the user via a corresponding input on the touchscreen 8. The reimbursement amount can then be paid out to the user via the money issue compartment 12 in cash. It is also possible for credit to be given to a loyalty card which can be read via the card reader 11.

A configuration is also conceivable in which the user declines the reimbursement offer and can remove the goods 13 again from the goods input region 4 without a reimbursement amount being paid out.

However, return of goods 13 in conjunction with a new purchase preferably takes place. In this case, a data processing device (not illustrated in any more detail) checks whether the returned goods 13 are in stock as a new product in the goods store 2 and then offers these goods for purchase on the touchscreen 8, wherein the purchase price for these goods is reduced by the reimbursement amount for the returned goods 13. If the user accepts this purchase offer by corresponding inputs on the touchscreen 8, he is requested to make a payment via the coin slot 9, the notes slot 10 or for a cashless payment by inputting a corresponding bank card into the card reader 11. Once the payment has been made, the purchased goods are dispensed using one of the goods output apparatuses 6.

It is of course also possible to purchase new goods from the goods store 2 without goods 13 previously having been returned via the goods input region 4. It is likewise possible to purchase, return a plurality of goods and/or to make a new purchase of another type of goods other than the returned goods 13 in one shopping operation.

FIGS. 2 to 13 illustrate in more detail the goods input region 4, which is arranged within the machine housing 30 (FIG. 1). The support element 15 on which goods 13 to be returned are positioned is arranged so as to be mounted rotatably behind a screen 16 (FIG. 3) with a cutout forming the insertion opening 14 (FIGS. 7 to 12).

The support element 15 has four support plates 17 arranged approximately in the form of a cross, by means of which support plates four input compartments arranged one behind the other in the direction of rotation are formed, of which in each case one can be arranged in the insertion position in the region of the insertion opening 14.

Figure 3:
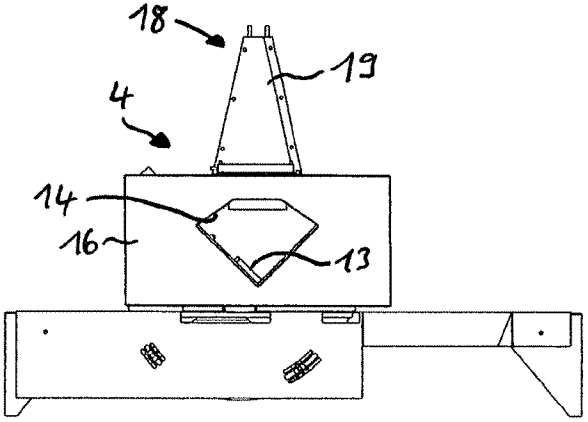
Figure 6:
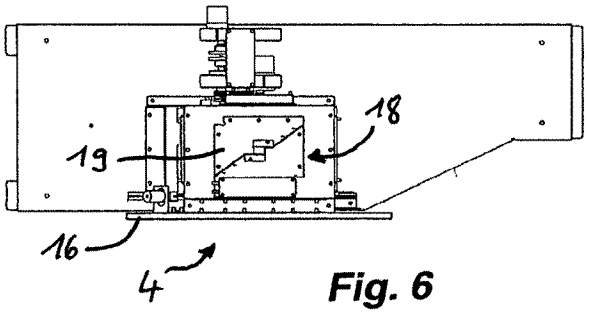
Figure 11:
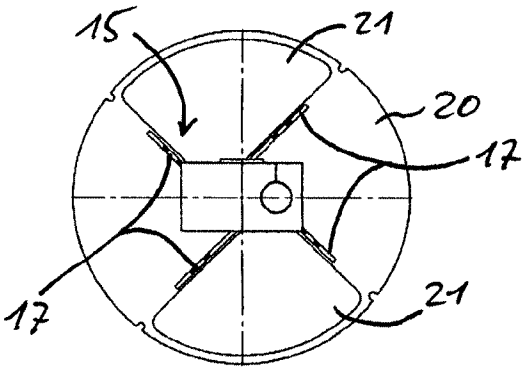
FIG. 9 to FIG. 11 show various side views of the support element with the closing element.
Figure 8:
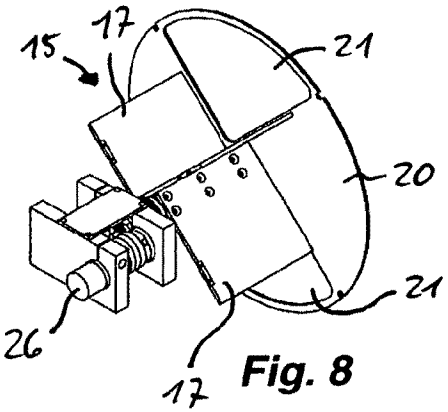
Figure 10:
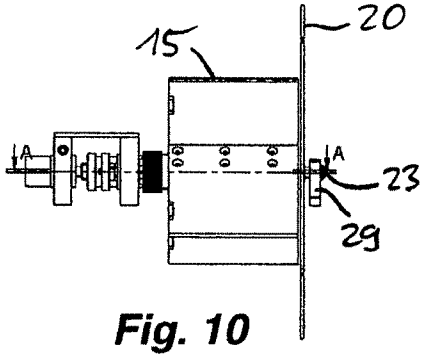
Figure 12:
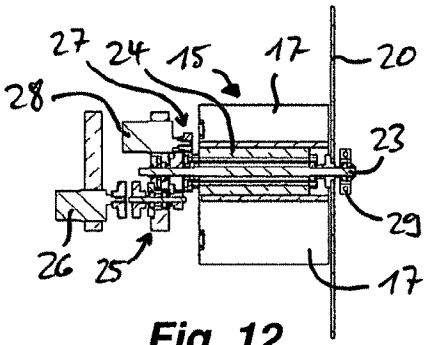
FIG. 12 shows a sectional view of the support element with the closing element.
Figure 9:
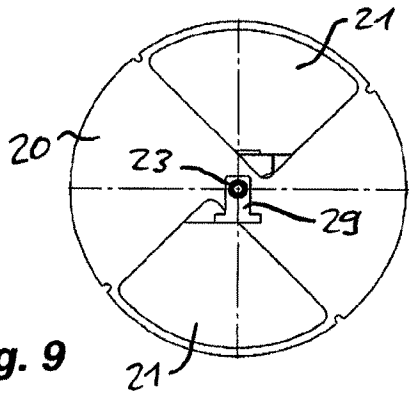
Figure 7:
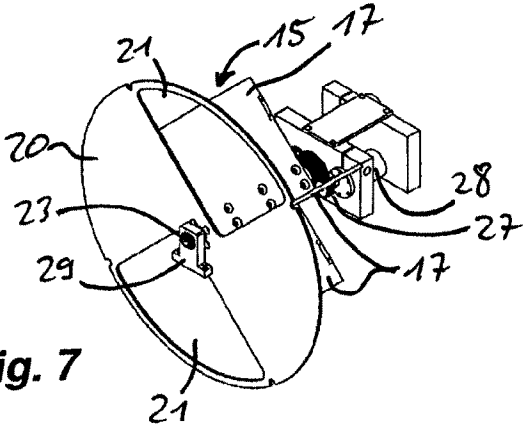

Goods 13 to be returned are inserted into the goods input region 4, with the result that the goods 13 rest with one side on one of the support plates 17 (FIG. 3). An identification apparatus 18 with a funnel-like housing 19 for shielding disruptive influences, in particular uncontrolled incident light, and a camera (not illustrated in any more detail) arranged in the upper region of the housing 19 is provided above the goods input region 4. If appropriate, a light source for targeted illumination of the goods 13 can be provided. With the camera pointing downwards, the goods 13 can be detected and investigated for certain features. In particular, a barcode applied to the goods 13 can be identified and the goods 13 can thus be uniquely identified. The identification apparatus 18 interacts with a data processing device (not illustrated) and a data storage device for this purpose. Identification of the goods 13 is also possible on the basis of other features. For example, color markings or printed text can be identified. It is also possible for a three-dimensional surface analysis to be performed by virtue of the outer contour of the goods 13 being detected or detection of the maximum extent of the goods 13 in all three spatial planes is performed and thus virtually a rectangular cuboid is laid around the goods 13. Such a surface analysis and/or contour detection can be used in particular for a plausibility check. For example, it is possible to check whether the contour and the dimensions of the goods 13 correspond to the goods determined according to a barcode. If discrepancies are established in this case, this can be interpreted as an attempt at fraud by application of a barcode to a worthless dummy article and payment of a reimbursement amount is denied.

If the goods 13 cannot at first be identified because, for example, the user has positioned the goods 13 with the barcode on the support plate 17, the support element 15 can be rotated until the goods 13 tip over and rest on the other support plate 17 of the respective input compartment. Thus, the initially hidden side of the goods 13 can be detected by the camera. In addition, the change in position of the goods 13 can help with the three-dimensional contour detection.

In order that there is a good contrast between the support plate 17 and the goods 13 and in order thus to optimize the identification rate, the surfaces of the support plates 17 are white.

After the identification operation, the support element 15 can be rotated to such an extent that the positioned goods 13 fall into a collecting container (not illustrated) arranged beneath the support element 15. Thus, the support element 15 is free for inserting further goods and the collected goods can easily be removed from the vending machine 1 via the collecting container.

It is possible in this case to arrange two collecting containers next to one another, into which goods can be supplied optionally. This can be achieved by rotation of the support element 15 optionally in one or the other direction. It is thus possible, for example, to collect different goods separately or to collect those goods for which a reimbursement has been paid out or settled, separately from those goods which could not be identified and are therefore unsuitable for the recycling process.

In order to firstly avoid disruptive light influences via the insertion opening 14 in the identification of the goods 13 and secondly injury as a result of a user reaching through the insertion opening 14 during rotation of the support element 15, a closing element 20 is provided which is arranged between the screen 16 and the support element 15 and can be used to close the insertion opening 14. The arrangement of the closing element 20 in the goods input region 4 can be seen particularly clearly in FIG. 4.

As can be seen easily in particular in FIGS. 7, 8, 9 and 11, the closing element 20 is in the form of a circular disk with two cutouts 21. If, as shown in the Figures, one of the cutouts 21 is located in the region of the insertion opening 14 or that input compartment of the support element 15 which is positioned for accommodating goods 13 to be returned, the closing element 20 is in its open position and goods 13 can be inserted into the goods input region 4. By rotation of the closing element 20 through 90°, the insertion opening 14 is closed by the closing element 20.

Figure 13:
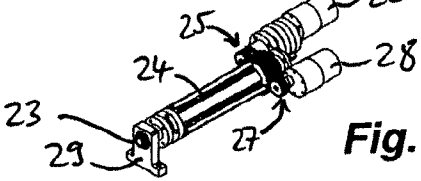
FIG. 13 shows a perspective view of the support element with the support plates omitted.
Figure 14:
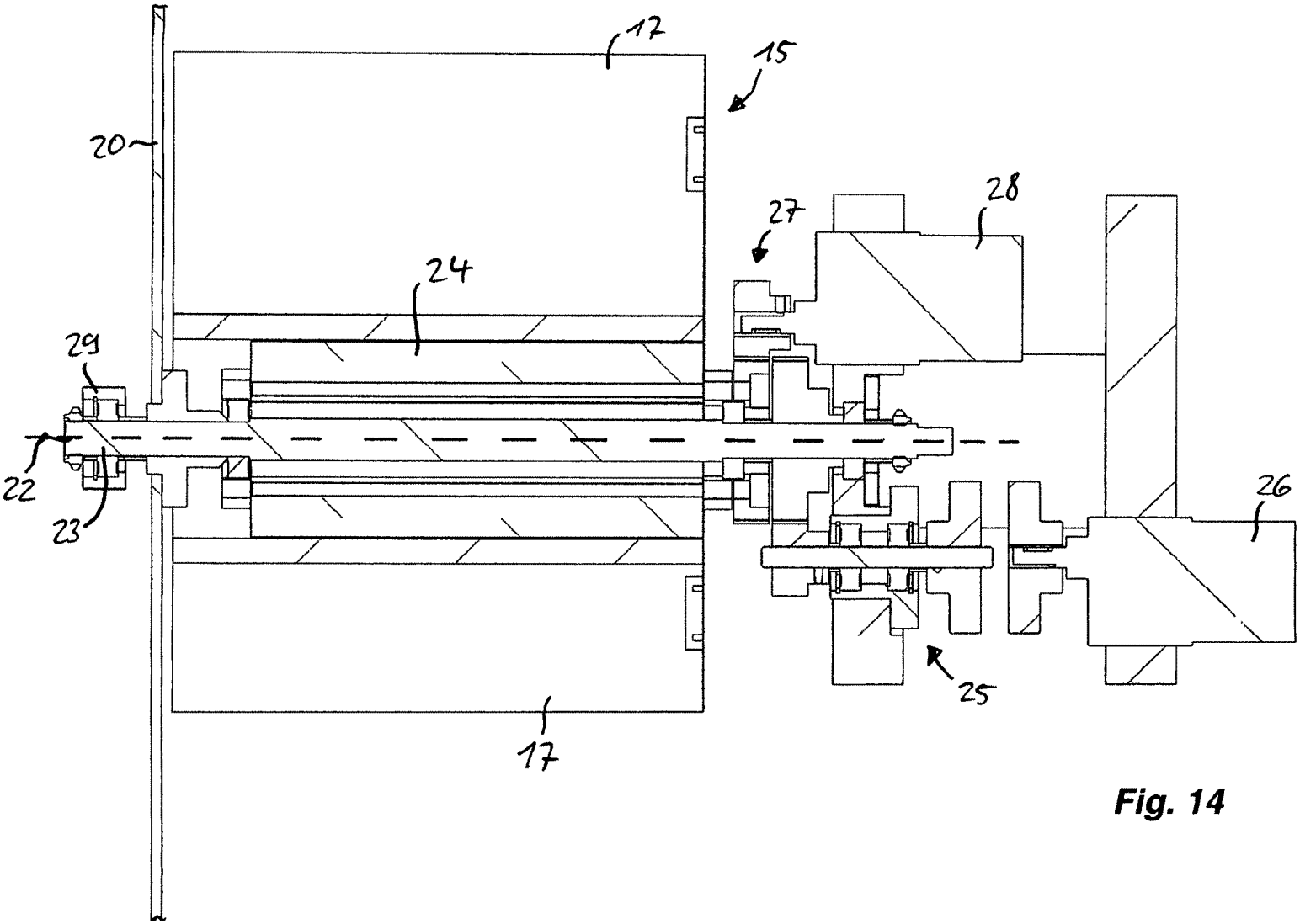
FIG. 14 shows a sectional view of the support element with closing element.

The support element 15 and the closing element 20 are rotatable about a common axis of rotation 22 (FIG. 14). For this, the closing element 20 is arranged on a shaft 23, which is mounted in a hollow shaft 24 of the support element 15. The shaft 23 is connected to a drive motor 26 via a transmission 25, and the hollow shaft 24 is likewise connected to a corresponding drive motor 28 via a separate transmission 27. As a result, the support element 15 and the closing element 20 can move independently of one another. The inner shaft 23 is mounted at its end remote from the drive motor 26 on a shaft bearing 29. The shaft arrangement together with the drives can also clearly be seen in FIG. 12. FIG. 13 shows a view of the shaft arrangement with shaft 23, hollow shaft 24, the transmissions 25, 27 and the drive motors 26, 28, with the omission of the support plates of the support element arranged on the hollow shaft 24 and the closing element arranged on the inner shaft 23.

Figure 15:
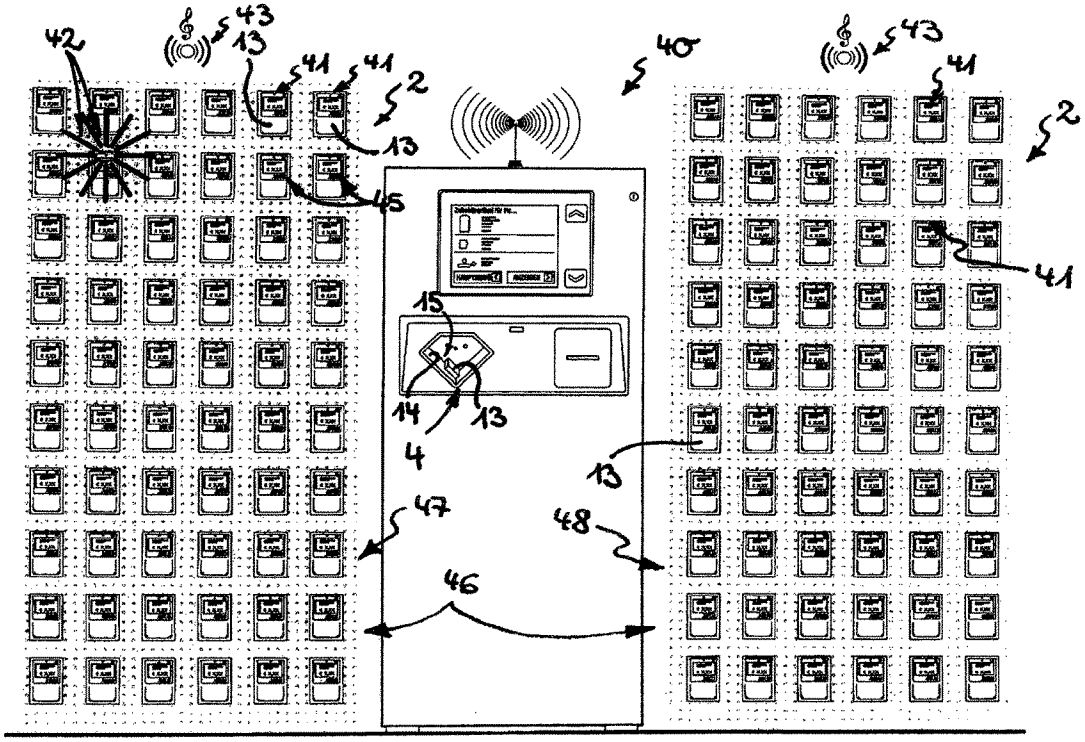
FIG. 15 shows a vending machine which has a plurality of goods carriers for stocking up with a large number of goods, wherein the vending machine has an identification apparatus for identification of old goods inserted into a goods input region, and wherein in each case at least one signal transducer is associated with the goods carriers or a group of goods carriers in such a way that, after identification of old goods inserted into the goods input region of the vending machine, the signal transducer or the signal transducers of a goods carrier or a group of goods carriers is/are activated, which signal transducer(s) is/are intended for stocking up with goods associated with the old goods.

FIG. 15 shows another vending machine 40, which is intended for ordered stock provision with even a large number of different goods. The vending machine 40 has an associated goods store 2, which can be stocked in ordered fashion by means of a plurality of goods carriers 41. The vending machine 40 has a goods input region 4, which is provided for inserting old goods intended for exchange, return or new purchase. For the identification of goods 13, said goods are positioned on a support element 15 through an insertion opening 14 of the goods input region 4. The vending machine 40 has an identification apparatus directed towards the goods input region 4, which identification apparatus interacts with a data processing device and a data storage device in such a way that old goods inserted into the goods input region 4 are detected by means of the identification apparatus optically, for example, on the basis of certain identification features or with the aid of a 3D file and are compared with the identification features or 3D files which are associated with goods in stock or the goods carriers 41 intended for stocking said goods in the data storage device. The goods input region 4 of the vending machine 40 as shown in FIG. 15 is configured in the same way as the goods input region 4 of the vending machine 1 illustrated in FIG. 1. Although the vending machine shown in FIG. 15 is also usable in conjunction with another suitable goods input region, the embodiment illustrated here is preferred. The vending machine 40 has signal transducers 42, 43, which are associated with a goods carrier 41 or a group of goods carriers 41. These signal transducers 42, 43 have a signal link to the data processing device in such a way that, after identification of old goods inserted into the goods input region 4 of the vending machine 40, the signal transducer 42, 43 of a goods carrier 41 or a group of goods carriers 41 is activated, which signal transducer(s) 42, 43 is/are intended for stocking goods associated with the old goods, for example with the same design. The identification device aligned with the goods input region 4 of the vending machine 40 is intended to identify the old goods in the goods input region 4 and, for this purpose, interacts with the data processing device and with the data storage device. The vending machine 40 facilitates for the user, on the basis of the old goods intended for exchange, return or new purchase, the selection of the goods in stock corresponding to said old goods, to be precise even for those products which are offered for sale in a large number of embodiments which are sometimes also only distinguishable with difficulty.

The signal transducers 42, 43 associated with the goods carriers 41 signal the new goods corresponding to the old goods by means of an optical or acoustic signal from the goods carriers 41 carrying these new goods.

Figure 16:
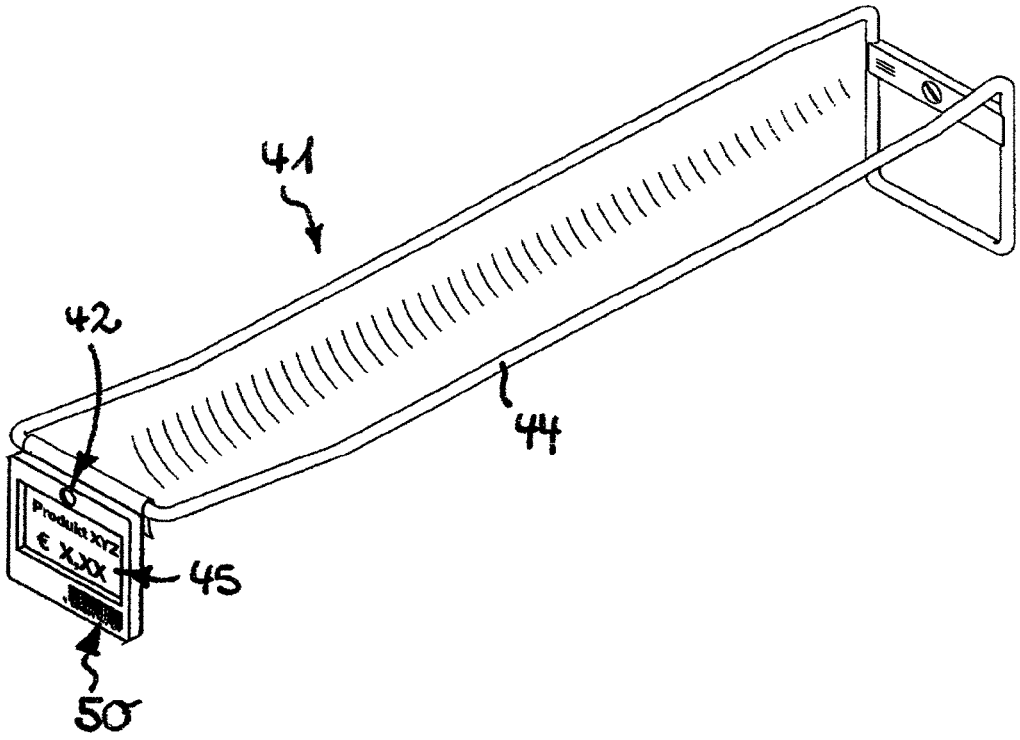
FIG. 16 shows a perspective view of one of the goods carriers of the vending machine shown in FIG. 15.

FIG. 16 illustrates one of the goods carriers 41 of the vending machine 40. The goods carrier 41 has a holding clip 44, on which, for example, goods 13 packaged in a blister pack or the packaging of the goods can be suspended. In order to be able to indicate further goods-specific data to the interested party relating to the products 13 in stock on the goods carriers 41, the goods carriers 41 have a display 45 here, on which the data are displayed by a current pulse and are preferably readable until these data are changed by a further current pulse. At least one blinking light source 42 is provided as optical signal transducer 42 on each of the goods carriers 41. FIG. 15 shows that the vending machine 40 has a partition wall 46, on which partition wall 46 the goods carriers 41 can preferably be fastened detachably. FIG. 15 also shows that the partition wall 46 is divided into partition wall sections 47, 48 on both sides of the vending machine 40, which partition wall sections 47, 48 have a group of goods carriers 41. An acoustic signal transducer 43 is associated with each of the partition wall sections 47, 48. If the user has inserted specific old goods in the goods input region of the vending machine 40, the vending machine 40 can begin with the identification of the inserted old goods by means of the identification apparatus aligned with the goods input region 13. As soon as the vending machine 40 has been able to identify the old goods, the vending machine 40 signals the new goods which correspond to the old goods and are in stock in the goods store. In this case, the partition wall section 47, 48 on which the goods carrier 41 carrying the selected new goods is also arranged is indicated acoustically with the aid of the acoustic signal transducer 43. This goods carrier 41 which is located in the region of the corresponding partition wall section 47 or 48 is additionally signaled by an optical signal transducer 42, wherein the optical signal transducer 42 is preferably provided on the corresponding goods carrier 41. At least one of the new goods which correspond to the old goods, for example having an identical design, are suspended on the corresponding goods carrier 41. As long as the signal transducers 42, 43 signal the location of the goods carrier 41 carrying the corresponding new goods, the user of the vending machine 40 can remove the new goods he requires from the vending machine 40 from the openly accessible goods store 2.

The goods input region integrated in the vending machine 40 can be intended merely for identifying old goods inserted only temporarily, but it is also possible for the old goods to also in this case be supplied to a collecting container once they have been identified and for the user to be credited, if appropriate.

FIG. 16 shows that the goods carriers 41 each have a display 45 for displaying goods-specific data relating to the goods in each case held in stock by means of the goods carrier 41 in question. In this case, the display 45 and the signal transducer 42 of each goods carrier 41 is actuable by the data processing device of the vending machine 40 via a wireless link. For this purpose, each goods carrier has a transmitter/receiver unit, which is connected to a corresponding transmitter/receiver unit of the data processing device. The transmitter/receiver units provided in the goods carriers 41 are operated by a (rechargeable) battery, wherein the transmitter/receiver unit of the goods carriers 41, when a state of charge is undershot, transmits a recharge signal to the data processing device, which recharge signal can be read at said data processing device. If, therefore, a goods carrier 41 is running the risk of its rechargeable battery or battery no longer having sufficient electrical energy, the transmitter/receiver unit of the goods carrier 41 in question transmits a recharge signal to the transmitter/receiver unit of the data processing device, where the goods carrier 41 in question is identified with a notification to the effect that its rechargeable battery needs to be recharged or its battery needs to be replaced next.

The vending machine 40 can also have associated management software, via which the user and in particular a retailer can bring sale articles, dates and prices into play for one or else many vending machines. The access rights to the vending machines 40 can be given to shop employees or distributed on a regional level or corporation level by virtue of a system of rights with detailed classification. FIG. 16 shows that a barcode 50 or similar identification can be provided on each display as well. In this way, the responsible shop employees can scan in the relevant goods carrier by means of a scanner, with the result that then the scanner communicates the barcode of the goods carrier 41 in question to the vending machine 40 and the data processing device thereof in order that the goods carrier 41 in question can then be linked with the product attached thereto by the shop employee and the associated information. The data processing device of the vending machine 40 can then display the goods-specific data associated with the product in question on the display 45 of the selected goods carrier 41, and also the goods carrier 41 which then needs to be actuated is then also stored in the data processing device. In the process, the data processing device assigns the goods carrier 41 in question to a group of goods carriers and the associated partition wall section 46 or 47 as well, with the result that in each case that acoustic signal transducer 43 which is associated with the goods group can also be actuated.

The invention claimed is:

1. A vending machine (40) with an associated goods store (2), said goods store (2) stocked in ordered fashion by a plurality of goods carriers, the vending machine comprising a goods input region (4) for inserting old goods intended for exchange or purchase by the vending machine, a data processing device, a data storage device, and an identification apparatus that recognizes the old goods in the goods input region (4), and a plurality of signal transducers (42, 43), said signal transducers being at least one of optical or acoustically signaling signal transducers (42, 43) which are each associated with a goods carrier (41) or a group of goods carriers (41), wherein an old goods, inserted into the goods input area (4), is detected by the identification device and is matched with identification features which are stored in the data storage device of a stocked new goods and the particular goods carriers (41) which are associated with the stock, wherein, a signal connection between the data processing device and the signal transducers (42, 43) is such that the signal transducer (42, 43) or the signal transducers of one of the goods carriers (41) or a group of goods carriers is activated/can be activated after identification of an old goods introduced into the goods input area (4) which is/are intended to stock one of the old goods associated with a new goods, and wherein the signal transducers (42, 43) associated with goods carriers (41) signals the new goods corresponding to the old goods via at least one of an optical or an acoustic signal, which the new goods carries, to freely accessible goods carriers.

2. The vending machine as claimed in claim 1, wherein the goods carriers (41) have a protruding holding web or holding clip (44), and the goods (13) or the packaging thereof is suspendable on said holding web or holding clip (44).

3. The vending machine as claimed in claim 1, wherein the goods carriers (41) have a display (45) for displaying goods-specific data of the goods (13) stored in each case by the goods carriers (41).

4. The vending machine as claimed in claim 1, wherein the goods carriers (41) each have at least one of the optical signal transducers (42).

5. The vending machine as claimed in claim 1, wherein the vending machine (40) has at least one partition wall (46), and goods carriers (41) are fastened detachably on said partition wall (46).

6. The vending machine as claimed in claim 5, wherein the partition wall (46) of the vending machine (40) is divided into partition wall sections (47, 48), said partition wall sections (47, 48) have a group of the goods carriers (41), and each of the partition wall sections (47, 48) has an associated one of the optical or acoustic signal transducers (42, 43).

7. The vending machine as claimed in claim 1, wherein the goods carriers have at least one of a display (45) or the signal transducer (42, 43), said display (45) or said signal transducer (42, 43) is actuatable by the data processing device via a wireless link.

8. The vending machine as claimed in claim 1, wherein the goods carriers (41) are connected to a corresponding transmitter/receiver unit of the data processing device via a transmitter/receiver unit.

9. The vending machine as claimed in claim 8, wherein the transmitter/receiver unit of the goods carriers (41) is operated by a battery, and the transmitter/receiver unit of the goods carrier (41), in the event of a state of charge being undershot, transmits a recharge signal to the data processing device, said recharge signal is readable at said data processing device.

10. The vending machine (1, 40) as claimed in claim 1, wherein the data processing device is connected to a user interface (3) for a user input depending on the identification result of the identification apparatus (18).

11. The vending machine as claimed in claim 10, wherein the vending machine (1, 40) has a collecting container for accommodating returned goods (13) after identification thereof.

12. The vending machine as claimed in claim 10, wherein the goods input region (4) has an insertion opening (14) which is closable by a closing element (20) which is fixable between an open position and a closed position.

* * * * *